US007293926B2

(12) United States Patent
Gueret

(10) Patent No.: US 7,293,926 B2
(45) Date of Patent: Nov. 13, 2007

(54) DEVICE COMPRISING A MECHANISM FOR DRIVING A STICK OR A MOVING PISTON IN A BASE PORTION

(75) Inventor: Jean-Louis Gueret, Paris (FR)

(73) Assignee: L'Oreal (FR)

( * ) Notice: Subject to any disclaimer, the term of this patent is extended or adjusted under 35 U.S.C. 154(b) by 0 days.

(21) Appl. No.: 10/685,877

(22) Filed: Oct. 15, 2003

(65) Prior Publication Data

US 2004/0120751 A1 Jun. 24, 2004

Related U.S. Application Data

(60) Provisional application No. 60/440,356, filed on Jan. 16, 2003.

(30) Foreign Application Priority Data

Oct. 16, 2002 (FR) ..... 02 12861

(51) Int. Cl.
*A45D 40/04* (2006.01)
*B43K 21/08* (2006.01)
*B43K 21/00* (2006.01)

(52) U.S. Cl. ..... 401/74; 401/78; 401/80

(58) Field of Classification Search ..... 401/54, 401/52, 75, 77, 78, 74, 80
See application file for complete search history.

(56) References Cited

U.S. PATENT DOCUMENTS 2,442,109 A * 5/1948 Anderson ..... 401/74
5,102,249 A 4/1992 Holloway et al.
5,171,096 A * 12/1992 Perrotti ..... 401/59
5,934,815 A * 8/1999 Hurlburt ..... 401/81
6,086,276 A * 7/2000 Gueret ..... 401/54
6,340,258 B2 * 1/2002 Gueret ..... 401/87
6,371,673 B1 * 4/2002 Gueret ..... 401/31

FOREIGN PATENT DOCUMENTS

FR 2780865 1/2000
FR 2790924 9/2000

* cited by examiner

*Primary Examiner*—David J. Walczak
(74) *Attorney, Agent, or Firm*—Lerner, David, Littenberg, Krumholz & Mentlik, LLP

(57) ABSTRACT

A device for packaging and dispensing a substance including a drive mechanism having a first part and a second part capable of rotating around an axis relative to the first part to dispense a substance. The first or second part having an element which is axially stationary along the axis relative to the other of the first or second part. The device further including a base part in which at least part of the second part is received and an anti-rotation element secured to the second part. The anti-rotational device adapted for cooperating with the base part in such a manner as to enable the drive mechanism to move axially along the axis relative to the base part while enabling the second part to be substantially stationary in rotation relative to the base part. An elastically deformable member is included for exerting a force against the drive mechanism.

21 Claims, 5 Drawing Sheets

DEVICE COMPRISING A MECHANISM FOR DRIVING A STICK OR A MOVING PISTON IN A BASE PORTION

CROSS REFERENCE TO RELATED APPLICATIONS

This application claims the benefit of U.S. Provisional Application No. 60/440,356 filed on Jan. 16, 2003, the disclosure of which is incorporated by reference herein.

BACKGROUND OF THE INVENTION

The present invention relates to packaging and dispenser devices, in particular for makeup.

Prior references disclose a dispenser device for a substance in the form of a stick. The stick is fixed in an end piece which is mounted to move in a cup, with a spring being interposed. The cup forms part of a drive mechanism enabling relative rotation between two parts to be transformed into axial displacement of the cup. The stick can be pushed in during application, thereby making it easier to deposit a uniform thick layer of substance and obtain new sensations during application. This device requires the provision of a specific cup and a specific stick-receiving end piece.

SUMMARY OF THE INVENTION

There exists a need for a device which enables the stick or an applicator end piece to move back and recoil during application. The device should be reliable and relatively simple and inexpensive to make. The present invention seeks specifically to satisfy these needs.

The present invention achieves this by means of a novel device for packaging and dispensing a substance, in particular a cosmetic. The device may include a drive mechanism having a first part and a second part, the second part being capable of turning relative to the first part in order to dispense the substance. The device also includes a base part in which at least a portion of the second part of the drive mechanism is received. The device being characterized by the fact that it may include anti-rotation means secured to the second part and cooperating with the base part in such a manner as to enable the drive mechanism to move axially relative to the base part while enabling the second part to be substantially stationary in rotation relative to the base part. Preferably, the device also includes an elastically deformable member exerting a return force against the drive mechanism which is being pushed into the base part. Such a device makes it possible in particular to use a standard drive mechanism, thereby providing an economic and efficient advantage.

At least one of the first and second parts may include at least one element that is axially stationary relative to the other one of the first or second part.

In one embodiment of the present invention, the anti-rotation means, i.e., anti-rotation element, may be implemented on a piece fastened to the second part of the drive mechanism. The anti-rotation element may include a portion of cross-section that is not circularly symmetrical, e.g. that is substantially polygonal or oval, or it may include at least one portion in relief such as a stud or a rib. The base part may be formed with an inside section having a corresponding shape to the anti-rotation element.

In an additional embodiment of the present invention, the anti-rotation element may be made with the second part of the drive mechanism, e.g., including at least one portion in relief cooperating with the base part, e.g., two or even four studs or ribs, which may preferably be uniformly distributed around the circumference of the second part. More generally, the second part may include a portion of cross-section that is not circularly symmetrical, for example that is substantially polygonal or oval. The base part being made with an inside section of corresponding shape.

The elastically deformable member may be fixed or made integrally to a piece of the device including the anti-rotation element. The elastically deformable member may also be free relative to the base part as well as the second part. The elastically deformable member may also be fastened to the base part or may be formed integrally therewith. The elastically deformable member may comprise a foam and/or a spring, for example a helical spring working in compression or in traction. The elastically deformable part may also comprise at least one portion made of an elastomer material. In particular, the elastically deformable member may comprise a central portion secured to the second part of the drive mechanism and a peripheral part secured to the base part. At least one bridge of material located between the two of them may be included, the bridges being formed from an elastomer material.

Where appropriate, the device of the present invention may include an abutment suitable for limiting the extent to which the drive mechanism may be recoiled into the base part. By way of example, such an abutment may be movable in order to enable the user to select the maximum amplitude with which the drive mechanism may be pushed into the base part during application.

The device may also include a member for initial adjustment of the deformation, in particular compression, of the elastically deformable member. The user thus can adjust the force exerted by the stick against the surface being treated. One of the deformation adjustment members or the base part may include a thread cooperating with a corresponding portion in relief on the other base part and the adjustment member, for example. The term "thread" is used to designate any portion in relief enabling axial displacement to be obtained as a result of a rotary movement. A thread may be constituted by one or more ramps, for example.

The above-mentioned abutment may be secured to the deformation adjustment member, e.g. by being made integrally therewith or by molding a plastic material.

The base portion may include at least one groove. The anti-rotation element may include at least one stud or rib configured to be capable of cooperating with the groove. For example, the base may include an inner sleeve with at least one groove, the groove being defined by a slot in the sleeve.

The drive mechanism, which is preferably standard, may include a cup supporting the substance in the form of a stick. The cup being suitable for being driven axially when the first part turns relative to the second part. The cup may include at least one stud slidably engaged in a slot of a tubular wall of the second part. The stud presenting an end that extends beyond the slot and that is engaged in a helical groove integral with the first part, e.g. being made in an inner sleeve fastened to the inside of an outer sleeve.

In a variant of the present invention, the cup may be secured to a threaded rod which cooperates with a tubular wall of the second part. The cup being configured to be capable of sliding without turning in the first part of the device. By replacing the cup with a piston suitable for sliding in a leak-tight manner inside the first part, it is possible to dispense a substance in liquid form such as, by providing the first part at one end with an applicator tip, e.g. a flocked tip.

The device may include a closure cap having a flexible element for limiting the extent to which the mechanism can be pushed into the base part when securing the closure cap while still providing a leak-tight closure.

The device may also include a closure cap having at least one block of cellular material that is elastically compressible in a multi-directional manner. The closure cap being placed in such a manner as to press a sealing member, for example a leakproof film, against the edge of a substance-outlet opening of the mechanism.

The present invention also provides a piece for assembling a base part to a drive mechanism having a first part and a second part capable of turning relative to the first part for the purpose of dispensing a substance. The piece includes both a portion arranged to be suitable for fastening to the second part and an anti-rotation element for cooperating with the base part in such a manner that the mechanism is capable of moving axially relative to the base part while enabling the second part to be substantially stationary in rotation relative to the base part.

BRIEF DESCRIPTION OF THE DRAWINGS

The present invention can be better understood on reading the following description of nonlimiting embodiments thereof, and on examining the accompanying drawings, in which:

FIGS. 14 and 15 are fragmentary and diagrammatic views of a variant of the present invention that makes it possible to adjust the maximum extent to which the drive mechanism can be pushed in;

DETAILED DESCRIPTION

Figure 1:
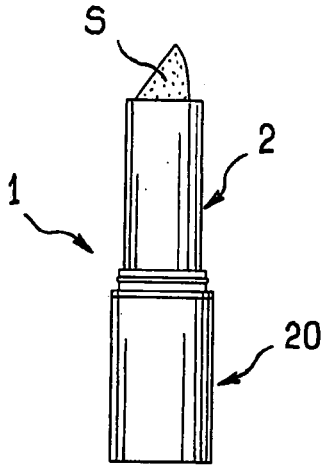
FIGS. 1 and 2 show an embodiment of a device of the present invention, respectively at rest after the stick has been extended and during application on a surface such as the skin.
Figure 2:
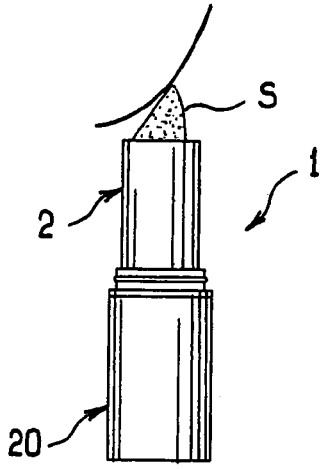
Figure 3:
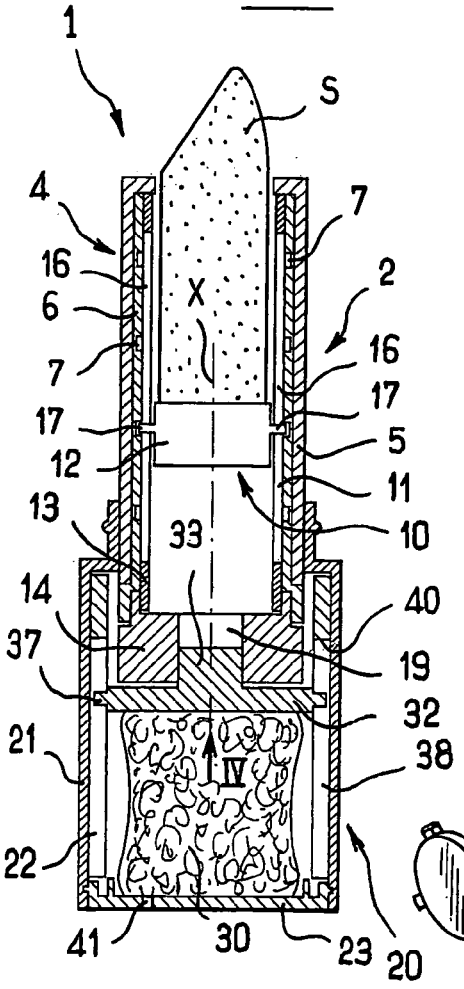
FIG. 3 is a cross-sectional view of the device in FIG. 1.
Figure 4:
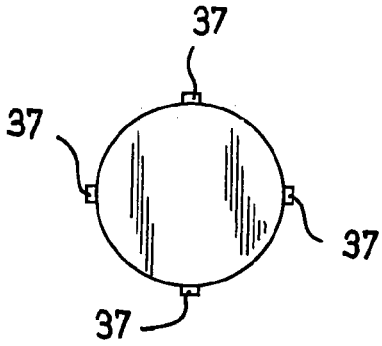
FIG. 4 is a cross-sectional view of the device in FIG. 1 taken along line IV.

FIGS. 1 to 3 show a packaging and dispenser device 1 constituting an embodiment of the present invention.

The device 1 includes a drive mechanism 2 enabling a stick S of a substance, such as a lipstick or a care product for the lips, to be moved between a retracted position (not shown) and an in-use position as shown in FIGS. 1 to 3.

The device 1 may include a closure cap (not shown in the figures) arranged to snap-fasten to a base part 20 that receives the drive mechanism 2.

With reference to FIG. 3, it can be seen that the drive mechanism 2, which may be similar to conventional drive mechanisms, includes a first part 4 having an outer sleeve 5 and an inner sleeve 6; the inner sleeve 6 being stationary relative to the outer sleeve 5 and being provided with two helical grooves 7. A second part 10 includes an insert 11, a knob 14 for driving the insert 11 and a cup 12 for supporting the stick S.

The insert 11 has a tubular wall 13 which is connected at its base to the knob 14. The knob 14 is provided with a central opening 19. The tubular wall 13 is fastened to the knob 14 by snap-fastening, for example. In the embodiment shown in FIG. 3, the tubular wall 13 has two diametrically opposite longitudinal slots 16 which cooperate with corresponding studs 17 of the cup 12.

More particularly, as can be seen in FIG. 3, these studs 17 are of sufficient length to pass through the slots 16 and penetrate into respective helical grooves 7 in the inner sleeve 6 so that turning the knob 14 causes the cup 12 to move axially relative to the first part 4.

In accordance with the present invention and in the embodiment shown in FIG. 3, at least part of the drive mechanism 2 is received inside the base part 20. The base part includes an outer cover piece 21 and an inner sleeve 22. The inner sleeve 22 is stationary relative to the outer piece 21. Additionally, a bottom piece 23 is fixed to the outer piece 21.

An elastically deformable member 30 is placed inside the base part 20 to enable the drive mechanism 2 to move backwards relative to the base part during application, as shown in FIG. 2. This also enables the drive mechanism 2 to return to its initial position as soon as application ceases.

In the example described, this elastically deformable member 30 is interposed between the bottom piece 23 and a coupling piece 32. The coupling piece 32 may include a central plug 33 fastened in the opening 19 of the knob 14.

Figure 5:
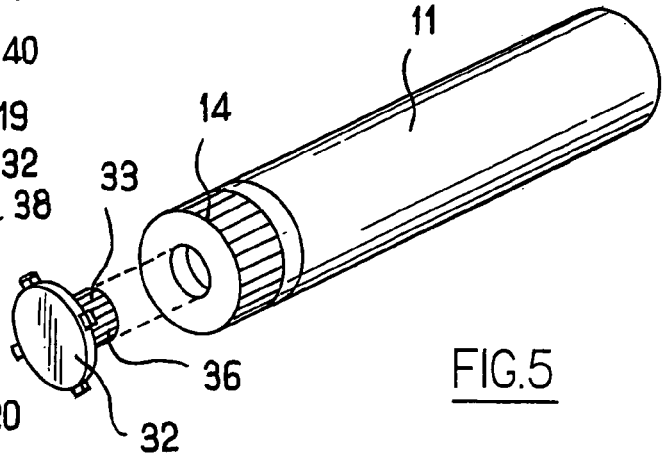
FIG. 5 is an exploded perspective view of a portion of the FIG. 3 device.

More particularly, it can be seen in FIG. 5 that this central plug 33 may include fluting 36 for increasing contact friction between the knob 14 and the coupling piece 32 and in particular for preventing any relative rotation between the coupling piece 32 and the knob 14.

At its periphery, the coupling piece 32 may have studs 37 engaged in longitudinal slots 38 located in the sleeve 22, thereby enabling the coupling piece 32 to move axially along the axis X of the device 1 without being able to turn relative to the base part 20. The inside diameter of the sleeve 22 is selected in such a manner that the knob 14 can move easily relative thereto. As shown in FIG. 3, the elastically deformable member 30 is already being compressed axially to a certain extent. The studs 37 of the piece 32 are at rest and located so that they press against the top ends 40 of the slots 38 in the inner sleeve 22.

Figure 6:
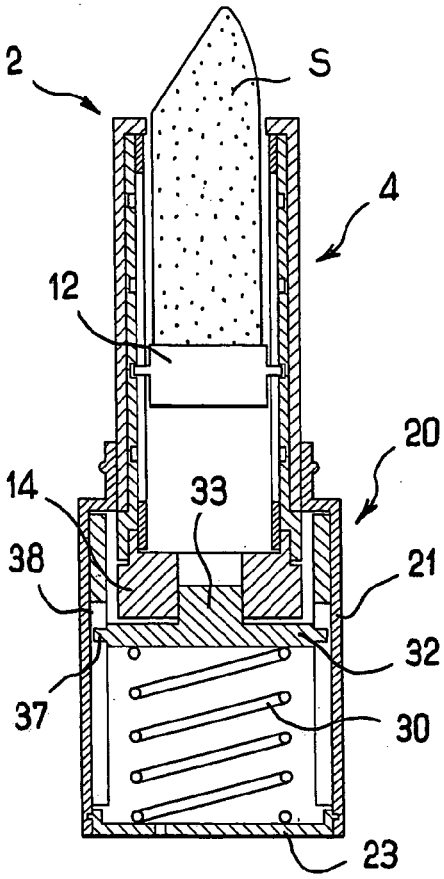
FIG. 6 is a cross-sectional view of a second embodiment of the present invention.

An orifice 41 may be made in the bottom piece 23 to allow air to escape when the drive mechanism 2 is pushed into the base part and vice versa. By way of example, the elastically deformable member 30 may be made in the form of a block of foam which can be free or fixed to the bottom piece 23 or to the coupling piece 32. In a variant of the present invention, it is possible to use a helical spring, as shown in FIG. 6.

In the embodiments of FIGS. 1 to 3, the anti-rotation means which serve to prevent relative rotation between the base part 20 and the knob 14 may be constituted by an anti-rotation element having studs 37 made integrally with the coupling piece 32.

Figure 7:
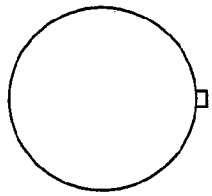
FIGS. 7 and 8 are bottom views analogous to FIG. 4, illustrating additional embodiments of the present invention.
Figure 8:
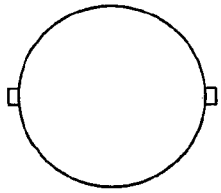
Figure 10:
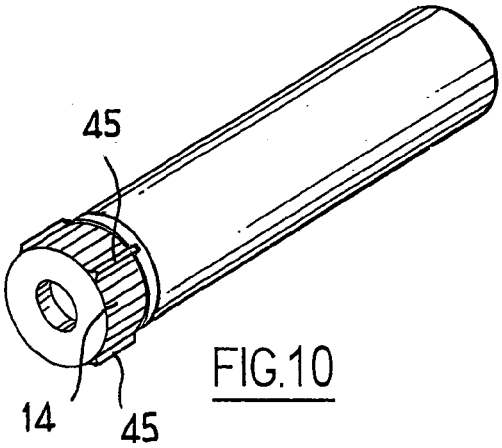
FIG. 10 illustrates part of the drive mechanism of the embodiment of FIG. 9.
Figure 9:
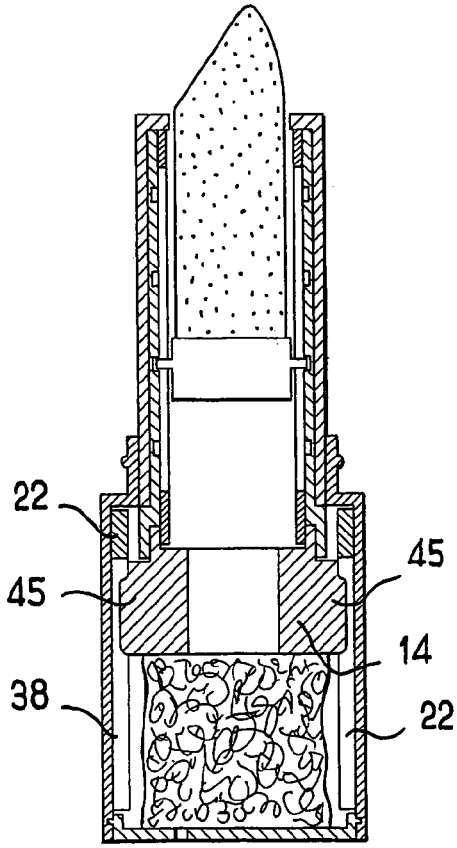
FIG. 9 is a cross-sectional view of an additional embodiment of the present invention.

Without going beyond the scope of the present invention, it is possible to make the anti-rotation element in some other way, for example instead of using four studs, it is possible to use a single stud or a pair of diametrically opposite studs, as shown in FIGS. 7 and 8 respectively. The anti-rotation element may also be formed integrally with the knob 14 as shown in FIGS. 9 and 10. In these figures, it can be seen that the anti-rotation element may be in the form of ribs 45 made on the periphery of the knob 14 and configured to be capable of cooperating with slots 38 in the sleeve 22. Such a configuration makes it possible to eliminate the coupling piece 32. The anti-rotation element may comprise a portion of cross-section that is not circularly symmetrical, as shown in FIGS. 11 to 13.

Figure 11:
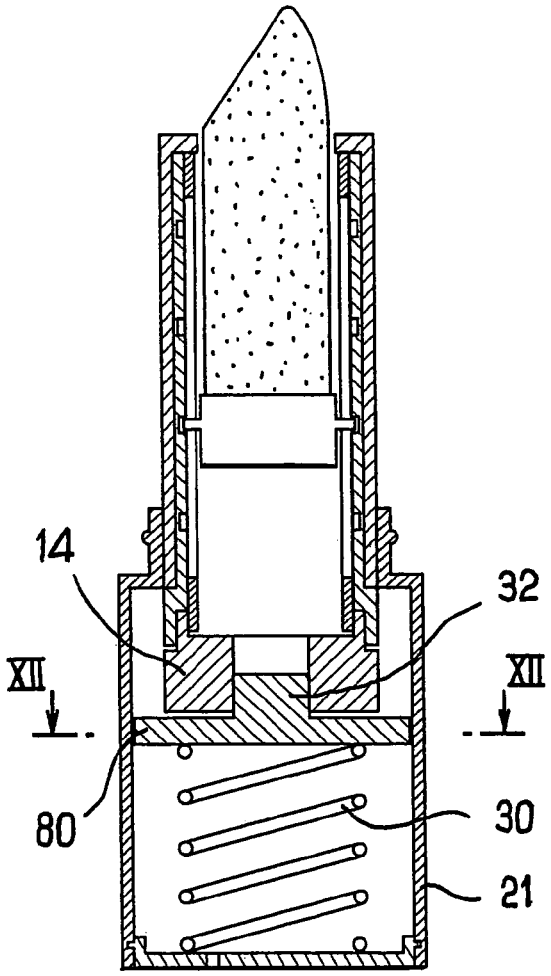
FIG. 11 is a cross-sectional view illustrating an additional embodiment of the present invention.
Figure 12:
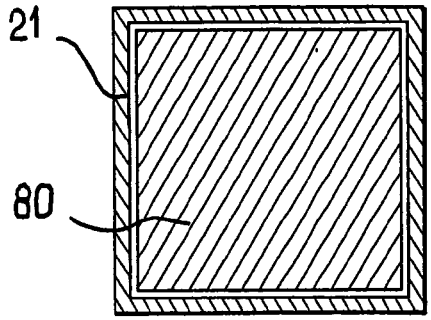
FIG. 12 is a cross-sectional view of the embodiment shown in FIG. 11 taken along axis line XII.
Figure 13:
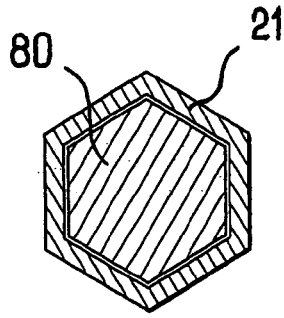
FIG. 13 is a view analogous to FIG. 12 illustrating an additional embodiment of the anti-rotation element of the present invention.

FIG. 11 shows a device in which the coupling piece 32 includes a portion 80 having a cross-section that is polygonal, for example square, as shown in FIG. 12 or hexagonal as shown in FIG. 13. The base part 20 may include an inside section having a corresponding shape to the coupling piece 32 so that the coupling piece 32 cannot turn relative to the base part 20. It is also possible to give other shapes to the portion 80, such as an oval shape.

In an additional embodiment of the present invention, the knob 14 may have a cross-section that is not circular, for example, it may be polygonal or oval in section and cooperate with a section of corresponding shape located on the base part 20.

Figure 14:
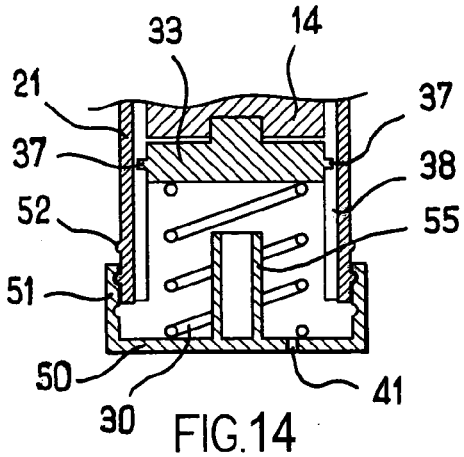
Figure 15:
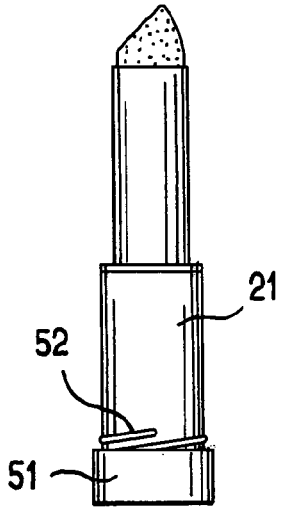

The base part 20 may be made with a member for adjusting the initial deformation of the elastically deformable member 30, as shown in FIGS. 14 and 15. Thus enabling the user to adjust the flexibility of the device as well as the initial force exerted on the elastically deformable member 30 prior to the drive mechanism 2 exerting a force against the base part 20. By way of example, this adjustment member may be in the form of a bottom piece 50. Bottom piece 50 replaces the above-described bottom piece referenced 23 and is provided with a threaded skirt 51 at its periphery. Threaded skirt 51 is configured to be screwed onto a thread 52 located on the outer piece 21. It will be understood that by tightening or loosening the bottom piece 50, it is possible to adjust the length of the spring 30 and pre-stress it to a greater or lesser extent.

The device may also include an abutment 55 enabling the user to adjust the maximum stroke over which the drive mechanism 2 can be pushed relative to the base part 20. By way of example, this abutment 55 may be made integrally with the bottom piece 50, as shown in FIG. 14. The abutment 55 may be in the form of a small-diameter cylindrical skirt suitable for use as a guide for the spring 30.

Naturally, without going beyond the scope of the present invention, it is possible to use drive mechanisms other than those described above with reference to FIGS. 1 to 15.

Figure 16:
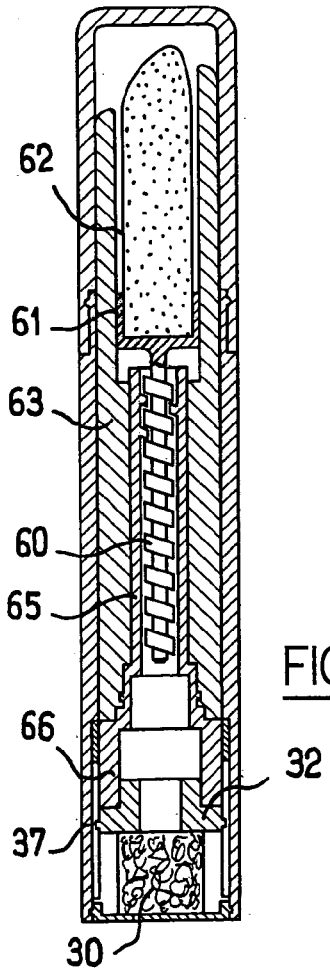
FIGS. 16 and 17 illustrate other additional embodiments of the present invention, each in diagrammatic axial section.

In particular, as shown in FIG. 16, it is possible to use a drive mechanism having a first part in the form of a threaded rod 60. The threaded rod being secured at one end to a substance-carrying cup 61. The substance-carrying cup 61 is capable of sliding without rotating within a housing 62 of an outer piece 63. The threaded rod 60 cooperates with a second part including a sleeve 65 secured at one end to a knob 66. The sleeve 65 is placed adjacent to the outer piece 63 in such a manner as to be capable of rotating without moving axially relative to the outer piece 63. Turning the knob 66 relative to the outer piece 63 causes the cup 61 to move axially relative thereto. This drive mechanism is received in the base part having the coupling piece 32 provided with anti-rotation element 37 and the elastically deformable member 30 in a manner similar to that described with reference to FIG. 3.

Figure 17:
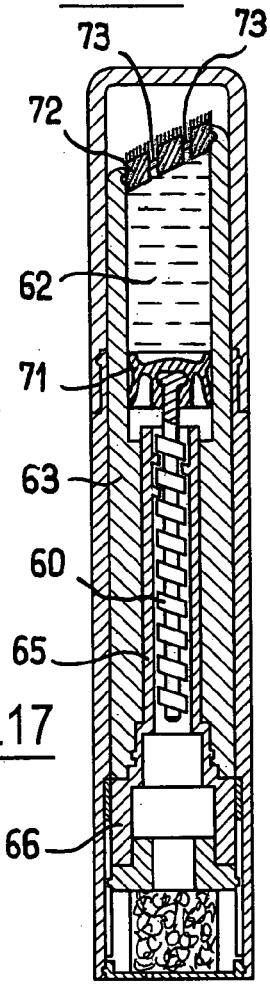

Also without going beyond the scope of the present invention, the stick S of substance may be replaced by a liquid, as shown in FIG. 17. The liquid may be dispensed by means of a mechanism quite similar to that shown in FIG. 16. The cup 61 being replaced by a piston 71, and the outer piece 63 being provided at its top end with an applicator tip 72 having at least one orifice 73 through which the liquid can escape when the piston 71 advances.

Figure 18:
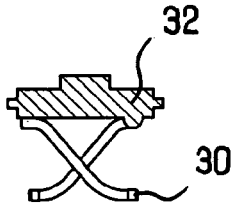
FIG. 18 illustrates an additional embodiment of the elastically deformable member and the anti-rotation element.
Figure 19:
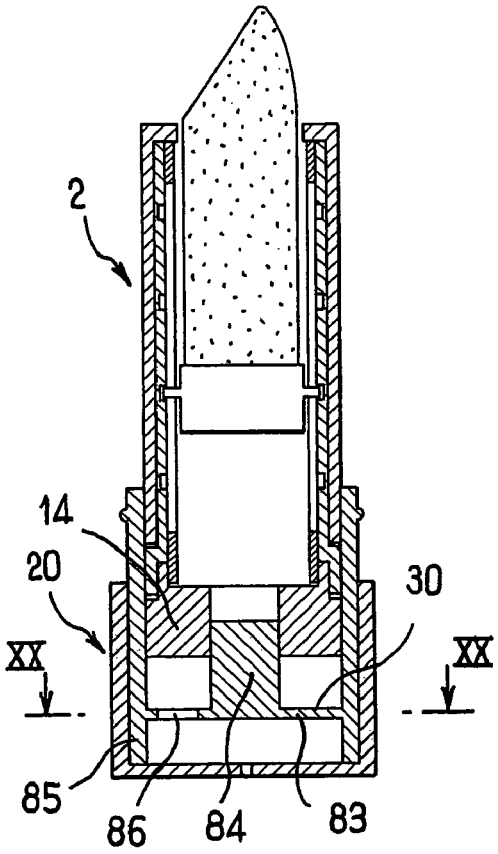
FIG. 19 is a fragmentary diagrammatic axial section view of an additional embodiment.
Figure 20:
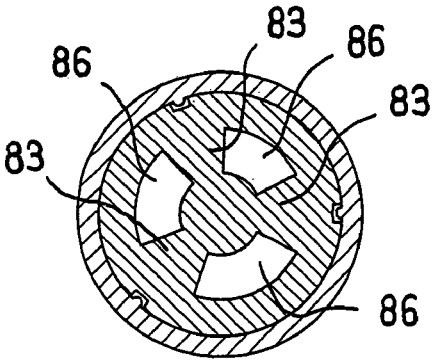
FIG. 20 is a cross-section view along line XX-XX of FIG. 19.

Naturally, numerous modifications may be applied to the embodiments described above. For example, the elastically deformable member 30 may be molded integrally with the coupling piece 32, as shown in FIG. 18. As shown in FIGS. 19 and 20, the elastically deformable member may also be made in the form of a plurality of elastically deformable bridges of material 83 connecting a central portion 84 fastened in the knob 14 to a peripheral portion 85 which is fastened to the base part 20. The bridges of material 83 may be uniformly spaced apart angularly, as can be seen in FIG. 20, leaving gaps 86 between one another.

The bridges 83 may be made of an elastomer material, which may be injected onto the central and peripheral parts 84 and 85. The parts being made of plastic or other material. The central and peripheral parts 84 and 85 may also be formed from the same elastically deformable material as the bridges 83. In use, the bridges 83 can deform elastically in elongation, thus enabling the mechanism to move back and forth inside the base part 20.

Figure 21:
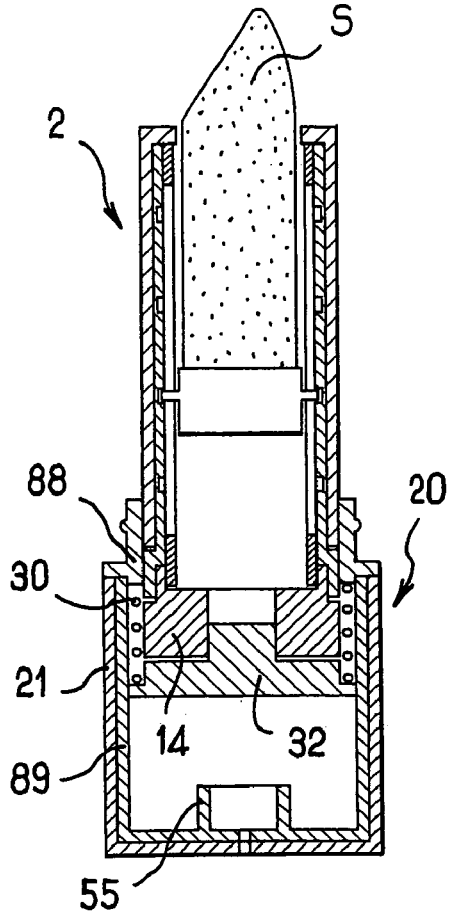
FIG. 21 is a diagrammatic axial section view illustrating an additional embodiment of the present invention in which the elastically deformable member works in traction.

The elastically deformable member may also work using traction, as shown in FIG. 21. The elastically deformable member 30 is in the form of a helical spring, being fastened at one end to a piece 88. The piece 88 is fastened to the base part 20 and rests against the end edge of the outer piece 21. The spring 30 is fastened at its other end to the piece 32 which is secured to the knob 14. In use, when the stick S is pressed against the lips, the mechanism 2 can recoil into the base part, thereby lengthening the spring 30.

It can also been seen in FIG. 21 that the base part 20 can receive a piece 89 with an abutment 55. The abutment 55 limits the maximum stroke with which the mechanism 2 may recoil into the base part 20.

Figure 22:
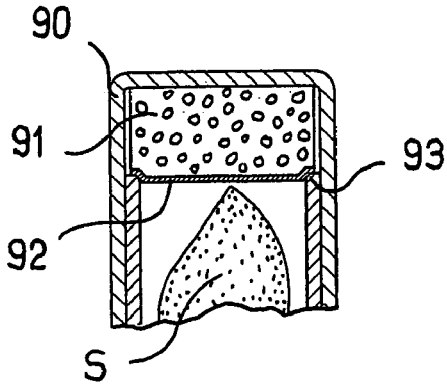
FIG. 22 is a diagrammatic and fragmentary axial section view illustrating a device provided with a cap for providing leak-tight closure.

In each of the above examples, the device may have a closure cap 90 which, as shown in FIG. 22, may include an elastically deformable element 91. The elastically deformable element 91 may include a membrane 92 disposed on its surface. The membrane 92 is designed to press in a leak-tight manner against the edge 93 of the mechanism when the cap 90 is in place. The element 91 may include an elastically compressible block of cellular material which is compressed by the free edge 93 of the mechanism when the cap 90 is in place on the device. This permits the cap to be fastened to the device by exerting only a small amount of force against the cap while nevertheless obtaining satisfactory sealing.

In the embodiments detailed in FIGS. 1 to 9, the bottom piece 23 is constituted by a snap-on piece; however, it would not go beyond the scope of the present invention for the base part to be made differently, in particular for it to have a bottom piece that is heat-sealed thereto.

It is also possible to use other drive mechanisms, such as a mechanism including means for absorbing excess pressure. The device may be arranged in such a manner to enable the drive mechanism to be replaced once the substance has been used.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A device for packaging and dispensing a substance comprising:

a drive mechanism having a first part having an axis and a second part, said second part capable of rotating around said axis relative to said first part to dispense said substance, one of said first and second parts having an element which is axially stationary along said axis relative to the other of said first or second parts;

a base part in which at least part of said second part is received;

an anti-rotation element secured to said second part, wherein said anti-rotation element cooperates with said base part so as to enable said drive mechanism to move axially along said axis relative to said base part while enabling said second part to be substantially stationary in rotation relative to said base part; and an independent elastically deformable member not integral with the said second part configured for exerting an upward restoring force against said drive mechanism as said second part is moved downward relative to said base part.

2. A device according to claim 1, wherein said anti-rotation element includes a coupling piece fastened to said second part, said coupling piece having a non-circular cross-section.

3. A device according to claim 2, wherein the elastically deformable member is interposed between said base part and said coupling piece.

4. A device according to claim 2, wherein said coupling piece includes at least one stud.

5. A device according to claim 2, wherein said elastically deformable member is attached to said coupling piece of said anti-rotation element.

6. A device according to claim 1, wherein said elastically deformable member is free relative to said base part and said second part.

7. A device according to claim 1, wherein said elastically deformable member is fixed to said base part.

8. A device according to claim 1, wherein said anti-rotation element is integral with said second part.

9. A device according to claim 1, wherein said elastically deformable member comprises a foam.

10. A device according to claim 1, wherein said base part includes at least one groove, said anti-rotation element includes at least one corresponding portion in relief comprising a stud or a rib configured to be capable of cooperating with said groove.

11. A device according to claim 10, wherein said base part includes an inner sleeve, and said groove comprises a slot in said sleeve.

12. A device according to claim 1, wherein said drive mechanism includes a cup supporting said substance, said cup being axially displaceable when said first part rotates relative to said second part.

13. A device for packaging and dispensing a substance comprising:

a drive mechanism including a first part having an axis and a second part, said second part capable of rotating around said axis relative to said first part to dispense said substance, one of said first and said second parts having an element that is axially stationary along said axis relative to the other of said first or second parts;

a base part wherein at least part of said second part is received;

at least one of:

at least one male member secured to said second part and cooperating with at least one female member secured to said base part in such a manner as to enable said drive mechanism to move axially along said axis relative to said base part while enabling said second part to be substantially stationary in rotation relative to said base part; and at least one female member secured to said second part and cooperating with at least one male member secured to said base part in such a manner as to enable said drive mechanism to move axially along said axis relative to said base part while enabling said second part to be substantially stationary in rotation relative to said base part; and an independent elastically deformable member not integral with said second part configured for exerting an upward restoring force against said drive mechanism as said second part is moved downward relative to said base part.

14. A device for packaging and dispensing a substance comprising:

a drive mechanism having a first part having an axis and a second part, said second part capable of rotating around said axis relative to said first part to dispense said substance, one of said first and second parts having an element which is axially stationary along said axis relative to the other of said first or second parts;

a base part in which at least part of said second part is received;

an anti-rotation element secured to said second part, wherein said anti-rotation element cooperates with said base part so as to enable said drive mechanism to move axially along said axis relative to said base part while enabling said second part to be substantially stationary in rotation relative to said base part;

an independent elastically deformable member not integral with said second part configured for exerting a force against said drive mechanism as a downward force is exerted on said drive mechanism toward said base part; and wherein said drive mechanism includes a cup supporting said substance, said cup being axially displaceable when said first part rotates relative to said second part, wherein said first part includes a helical groove and said second part includes a tubular wall including a slot, said cup including at least one stud slidably engaged in said slot, said stud having an end extending beyond said slot and engaged in said helical groove.

15. A device according to claim 1, wherein the elastically deformable member is made in the form of a plurality of elastically deformable bridges of material connecting a central portion fastened to said second part to a peripheral portion which is fastened to said base part.

16. A device according to claim 15, wherein said second part includes an insert, a knob for driving the insert and a cup for supporting a stick, said insert having a tubular wall connected at its base to said knob and said central portion being fastened to said knob.

17. A device according to claim 1, wherein the elastically deformable member works using traction.

18. A device according to claim 1, wherein the elastically deformable member comprises a spring.

19. A device according to claim 1, wherein the elastically deformable member is free relative to both the base part and the second part.

20. A device for packaging and dispensing a substance comprising:

a drive mechanism having a first part having an axis and a second part, said second part being capable of rotating around said axis relative to said first part to dispense said substance, one of said first and second parts having an element which is axially stationary along said axis relative to the other of said first or second parts;

a base part in which at least part of said second part is received;

an anti-rotation element secured to said second part, wherein said anti-rotation element cooperates with said base part so as to enable said drive mechanism to move axially along said axis relative to said base part while enabling said second part to be substantially stationary in rotation relative to said base part; and an elastically deformable member free relative to said base part and said second part and configured for exerting an upward restoring force against said drive mechanism as said second part is moved downward relative to said base part.

21. A device for packaging and dispensing a substance comprising:

a drive mechanism having a first part having an axis and a second part, said second part being capable of rotating around said axis relative to said first part to dispense said substance, one of said first and second parts having an element which is axially stationary along said axis relative to the other of said first or second parts;

a base part in which at least part of said second part is received;

an anti-rotation element secured to said second part, wherein said anti-rotation element cooperates with said base part so as to enable said drive mechanism to move axially along said axis relative to said base part while enabling said second part to be substantially stationary in rotation relative to said base part; and an elastically deformable member comprising a foam, configured for exerting an upward restoring force against said drive mechanism as said second part is moved downward relative to said base part.

* * * * *

UNITED STATES PATENT AND TRADEMARK OFFICE

CERTIFICATE OF CORRECTION

PATENT NO. : 7,293,926 B2
APPLICATION NO. : 10/685877
DATED : November 13, 2007
INVENTOR(S) : Jean-Louis Gueret It is certified that error appears in the above-identified patent and that said Letters Patent is hereby corrected as shown below:

Title Page In the Abstract, line 4, “having” should read -- has --.
Title Page In the Abstract, line 7, “including” should read -- includes --.
Title Page In the Abstract, line 9, after “device” insert -- is --.
Column 1, line 42, “being” should read -- is --.
Column 2, line 7, “being” should read -- is --.
Column 2, line 55, “being” should read -- is --.
Column 2, line 58, “presenting” should read -- presents --.
Column 2, line 64, “being” should read -- is --.
Column 3, line 10, “being” should read -- is --.
Column 5, line 49, “enabling the user to” should read -- the user is able to --.
Column 6, line 6, “being” should read -- is --.
Column 6, line 24, “being” should read -- is --.
Column 6, line 25, “being” should read -- is --.
Column 6, line 41, “being” should read -- are --.
Column 7, line 28, “part capable” should read -- part being capable --.
Column 8, line 16, “part capable” should read -- part being capable --.
Column 8, line 46, “part capable” should read -- part being capable --.

Signed and Sealed this

Seventh Day of April, 2009

JOHN DOLL
*Acting Director of the United States Patent and Trademark Office*